US006915246B2

(12) United States Patent
Gusler et al.

(10) Patent No.: US 6,915,246 B2
(45) Date of Patent: Jul. 5, 2005

(54) EMPLOYING SPEECH RECOGNITION AND CAPTURING CUSTOMER SPEECH TO IMPROVE CUSTOMER SERVICE

(75) Inventors: Carl Phillip Gusler, Austin, TX (US); Rick Allen Hamilton, II, Charlottesville, VA (US); Timothy Moffett Waters, Richmond, VA (US)

(73) Assignee: International Business Machines Corporation, Armonk, NY (US)

( * ) Notice: Subject to any disclaimer, the term of this patent is extended or adjusted under 35 U.S.C. 154(b) by 750 days.

(21) Appl. No.: 10/015,290

(22) Filed: Dec. 17, 2001

(65) Prior Publication Data

US 2003/0115064 A1 Jun. 19, 2003

(51) Int. Cl.[7] ..... G06G 7/48
(52) U.S. Cl. ..... 703/5; 705/243; 705/255
(58) Field of Search ..... 703/5; 379/88.01; 704/243, 244, 251, 255; 705/243, 246, 255

(56) References Cited

U.S. PATENT DOCUMENTS

| | | | | |
|---|---|---|---|---|
| 5,724,416 | A | | 3/1998 | Foladare et al. |
| 5,797,116 | A | | 8/1998 | Yamada et al. |
| 5,832,063 | A | | 11/1998 | Vysotsky et al. |
| 6,055,497 | A | | 4/2000 | Hallkvist et al. |
| 6,100,882 | A | | 8/2000 | Sharman et al. |
| 6,122,615 | A | | 9/2000 | Yamamoto |
| 6,141,661 | A | | 10/2000 | Brown et al. |
| 6,205,428 | B1 | | 3/2001 | Brown et al. |
| 6,223,158 | B1 | | 4/2001 | Goldberg |
| 6,243,454 | B1 | | 6/2001 | Eslambolchi |
| 6,370,504 | B1 | * | 4/2002 | Zick et al. ..... 704/251 |
| 6,404,872 | B1 | * | 6/2002 | Goldberg et al. ..... 379/201.11 |
| 6,462,500 | B1 | * | 10/2002 | L'Hegarat et al. ..... 318/649 |
| 6,487,530 | B1 | * | 11/2002 | Lin et al. ..... 704/244 |
| 6,532,444 | B1 | * | 3/2003 | Weber ..... 704/257 |

OTHER PUBLICATIONS

Phillips, "VoiceXML and the Voice / Web Environment Visual Programming Tools for Telephone Application Development," *Dr. Dobb's Journal*, vol. 26, Issue 10, pp. 91–96, Oct. 2001.

Nuance Communications, *The Business Case for Speech Recognition*, 2000 (White paper available at www.nuance.com).

* cited by examiner

*Primary Examiner*—Albert W. Paladini
(74) *Attorney, Agent, or Firm*—Stephen J. Walder, Jr.; David A. Mims, Jr.

(57) ABSTRACT

The present invention comprises receiving speech input from two or more speakers, including a first speaker (such as a customer service representative for example); blocking a portion of the speech input that originates from the first speaker; and processing the remaining portion of the speech input with a computer. The blocking and processing are real-time processes, completed during a conversation. One example is a method for de-cluttering speech input for better automatic processing, by removing all but the pertinent words spoken by a customer. Another example is a system for executing methods of the present invention. A third example is a set of instructions on a computer-usable medium, or resident in a computer system, for executing methods of the present invention.

19 Claims, 6 Drawing Sheets

EMPLOYING SPEECH RECOGNITION AND CAPTURING CUSTOMER SPEECH TO IMPROVE CUSTOMER SERVICE

CROSS-REFERENCES TO RELATED APPLICATIONS

The present application is related to a co-pending application entitled *Employing Speech Recognition and Key Words to Improve Customer Service,* filed on even date herewith, assigned to the assignee of the present application, and herein incorporated by reference.

FIELD OF THE INVENTION

The present invention relates generally to information handling, and more particularly to methods and systems employing computerized speech recognition and capturing customer speech to improve customer service.

BACKGROUND OF THE INVENTION

Many approaches to speech transmission and speech recognition have been proposed in the past, including the following examples: U.S. Pat. No. 6,100,882 (Sharman, et al., Aug. 8, 2000), "Textual Recording of Contributions to Audio Conference Using Speech Recognition," relates to producing a set of minutes for a teleconference. U.S. Pat. No. 6,243,454 (Eslambolchi, Jun. 5, 2001), "Network-Based Caller Speech Muting," relates to a method for muting a caller's outgoing speech to defeat transmission of ambient noise, as with a caller in an airport. U.S. Pat. No. 5,832,063 (Vysotsky et al., Nov. 3, 1998), relates to speaker-independent recognition of commands, in parallel with speaker-dependent recognition of names, words or phrases, for speech-activated telephone service. However, the above-mentioned examples address substantially different problems (i.e. problems of telecommunications service), and thus are significantly different from the present invention.

There are methods and systems in use today that utilize automatic speech recognition to replace human customer service representatives. Automatic speech recognition systems are capable of performing some tasks; however, a customer may need or prefer to actually speak with another person in many cases. Thus there is a need for systems and methods that use both automatic speech recognition, and human customer service representatives, automatically capturing customer speech to improve the customer service rendered by humans.

SUMMARY OF THE INVENTION

The present invention comprises receiving speech input from two or more speakers, including a first speaker (such as a customer service representative for example); blocking a portion of the speech input that originates from the first speaker; and processing the remaining portion of the speech input with a computer. The blocking and processing are real-time processes, completed during a conversation.

Consider some examples that show advantages of this invention. It would be advantageous to extract the words spoken by a customer who is engaged in a conversation with another person (such as a customer service representative for example). Then the customer's speech could be processed (by automatic speech recognition, or speaker recognition, for example), to provide faster, better service to the customer. The customer's knowledge (of requirements or problems, for example) is unique. Thus it may be useful to identify key words spoken by a customer, through speech recognition technology, for example. On the other hand, it may be useful to transcribe a customer's words, or use the customer's words as commands. The customer's voice is unique, leading to automatic authentication through speaker recognition technology, for example. There would be no need to prolong a transaction by having a customer service representative repeat, or manually type, information that could be derived automatically from a customer's speech. The present invention could de-clutter the speech input for better automatic processing, by removing all but the pertinent words spoken by the customer.

BRIEF DESCRIPTION OF THE DRAWINGS

A better understanding of the present invention can be obtained when the following detailed description is considered in conjunction with the following drawings. The use of the same reference symbols in different drawings indicates similar or identical items.

DETAILED DESCRIPTION

Figure 1:
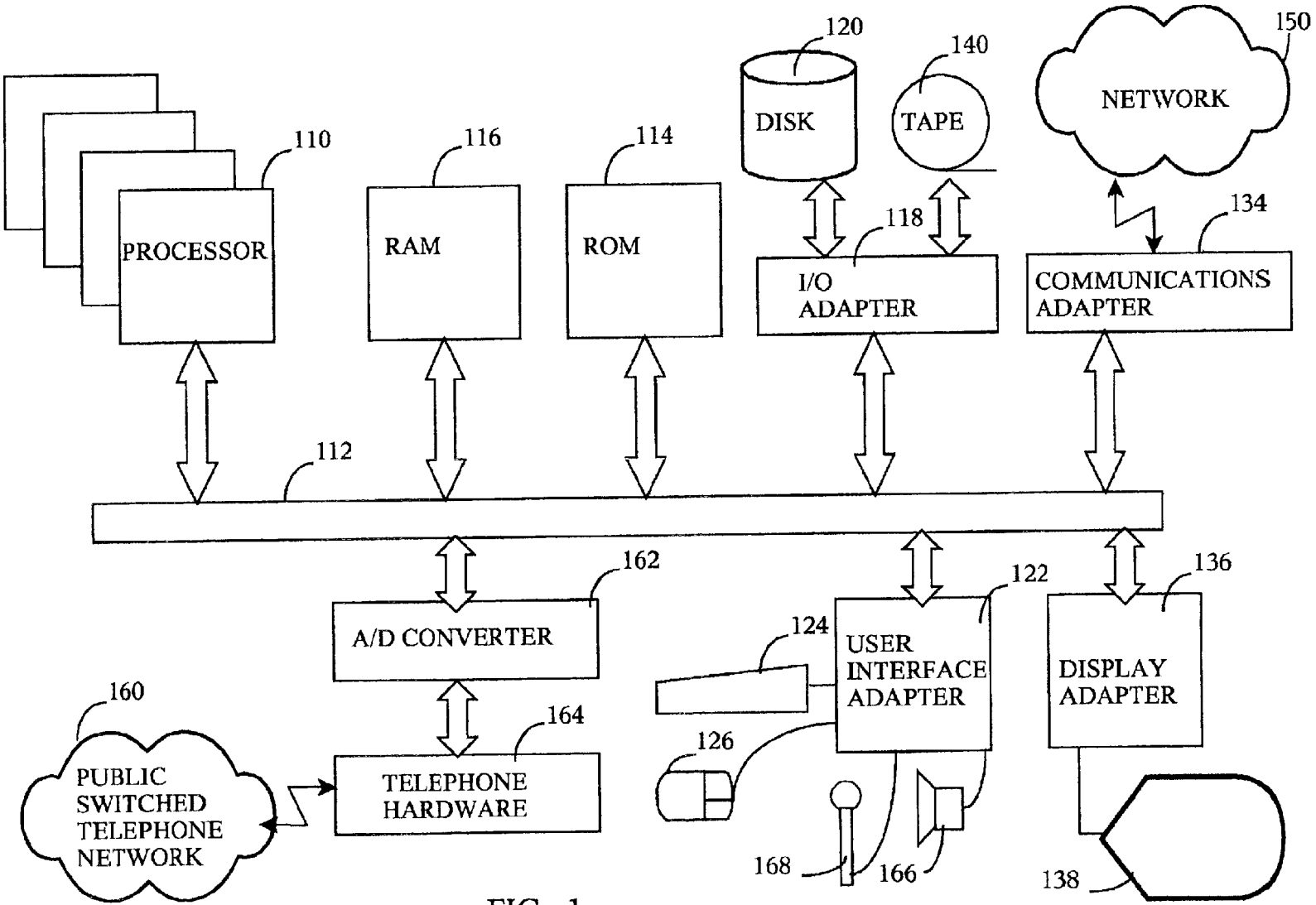
FIG. 1 illustrates a simplified example of a computer system capable of performing the present invention.

The examples that follow involve the use of one or more computers and may involve the use of one or more communications networks. The present invention is not limited as to the type of computer on which it runs, and not limited as to the type of network used.

As background information for the present invention, reference is made to the book by M. R. Schroeder, *Computer Speech: Recognition, Compression, Synthesis,* 1999, Springer-Verlag, Berlin, Germany. This book provides an overview of speech technology, including automatic speech recognition and speaker identification. This book provides introductions to two common types of speech recognition technology: statistical hidden Markov modeling, and neural networks. Reference is made to the book edited by Keith Ponting, *Computational Models of Speech Pattern Processing,* 1999, Springer-Verlag, Berlin, Germany. This book contains two articles that are especially useful as background information for the present invention. First, the article by Steve Young, "Acoustic Modeling for Large Vocabulary Continuous Speech Recognition," at pages 18–39, provides a description of benchmark tests for technologies that perform speaker-independent recognition of continuous speech. (At the time of that publication, the state-of-the-art performance on "clean speech dictation within a limited domain such as business news" was around 7% word error [WER].) Secondly, the article by Jean-Paul Haton, "Connectionist and Hybrid Models for Automatic Speech Recognition," pages 54–66, provides a survey of research on hidden Markov modeling and neural networks.

The following are some examples of speech recognition technology that would be suitable for implementing the present invention. Large-vocabulary technology is available from IBM in the VIAVOICE and WEBSPHERE product families. SPHINX speech-recognition technology is freely available via the World Wide Web as open source software, from the Computer Science Division of Carnegie Mellon University, Pittsburgh, Pa. SPHINX 2 is described as real-time, large-vocabulary, and speaker-independent. SPHINX 3 is slower but more accurate, and may be suitable for transcription for example. Other technology similar to the above-mentioned examples also may be used.

Another technology that may be suitable for implementing the present invention is extensible markup language (XML), and in particular, VoiceXML. XML provides a way of containing and managing information that is designed to handle data exchange among various data systems. Thus it is well-suited to implementation of the present invention. Reference is made to the book by Elliotte Rusty Harold and W. Scott Means, *XML in a Nutshell* (O'Reilly & Associates, 2001). As a general rule XML messages use "attributes" to contain information about data, and "elements" to contain the actual data. As background information for the present invention, reference is made to the article by Lee Anne Phillips, "VoiceXML and the Voice/Web Environment: Visual Programming Tools for Telephone Application Development," *Dr. Dobb's Journal,* Vol. 26, Issue 10, pages 91–96, October 2001. One example described in the article is a currency-conversion application. It receives input, via speech and telephone, of an amount of money. It responds with an equivalent in another currency either via speech or via data display.

The following are definitions of terms used in the description of the present invention and in the claims:

"Customer" means a buyer, client, consumer, patient, patron, or user.

"Customer service representative" or "service representative" means any professional or other person who interacts with a customer, including an agent, assistant, broker, banker, consultant, engineer, legal professional, medical professional, or sales person.

"Computer-usable medium" means any carrier wave, signal or transmission facility for communication with computers, and any kind of computer memory, such as floppy disks, hard disks, Random Access Memory (RAM), Read Only Memory (ROM), CD-ROM, flash ROM, non-volatile ROM, and non-volatile memory.

"Storing" data or information, using a computer, means placing the data or information, for any length of time, in any kind of computer memory, such as floppy disks, hard disks, Random Access Memory (RAM), Read Only Memory (ROM), CD-ROM, flash ROM, non-volatile ROM, and non-volatile memory.

FIG. 1 illustrates a simplified example of an information handling system that may be used to practice the present invention. The invention may be implemented on a variety of hardware platforms, including personal computers, workstations, servers, and embedded systems. The computer system of FIG. 1 has at least one processor 110. Processor 110 is interconnected via system bus 112 to random access memory (RAM) 116, read only memory (ROM) 114, and input/output (I/O) adapter 118 for connecting peripheral devices such as disk unit 120 and tape drive 140 to bus 112. The system has analog/digital converter 162 for connecting the system to telephone hardware 164 and public switched telephone network 160. The system has user interface adapter 122 for connecting keyboard 124, mouse 126, or other user interface devices such as audio output device 166 and audio input device 168 to bus 112. The system has communication adapter 134 for connecting the information handling system to a data processing network 150, and display adapter 136 for connecting bus 112 to display device 138. Communication adapter 134 may link the system depicted in FIG. 1 with hundreds or even thousands of similar systems, or other devices, such as remote printers, remote servers, or remote storage units. The system depicted in FIG. 1 may be linked to both local area networks (sometimes referred to as Intranets) and wide area networks, such as the Internet.

While the computer system described in FIG. 1 is capable of executing the processes described herein, this computer system is simply one example of a computer system. Those skilled in the art will appreciate that many other computer system designs are capable of performing the processes described herein.

Figure 2:
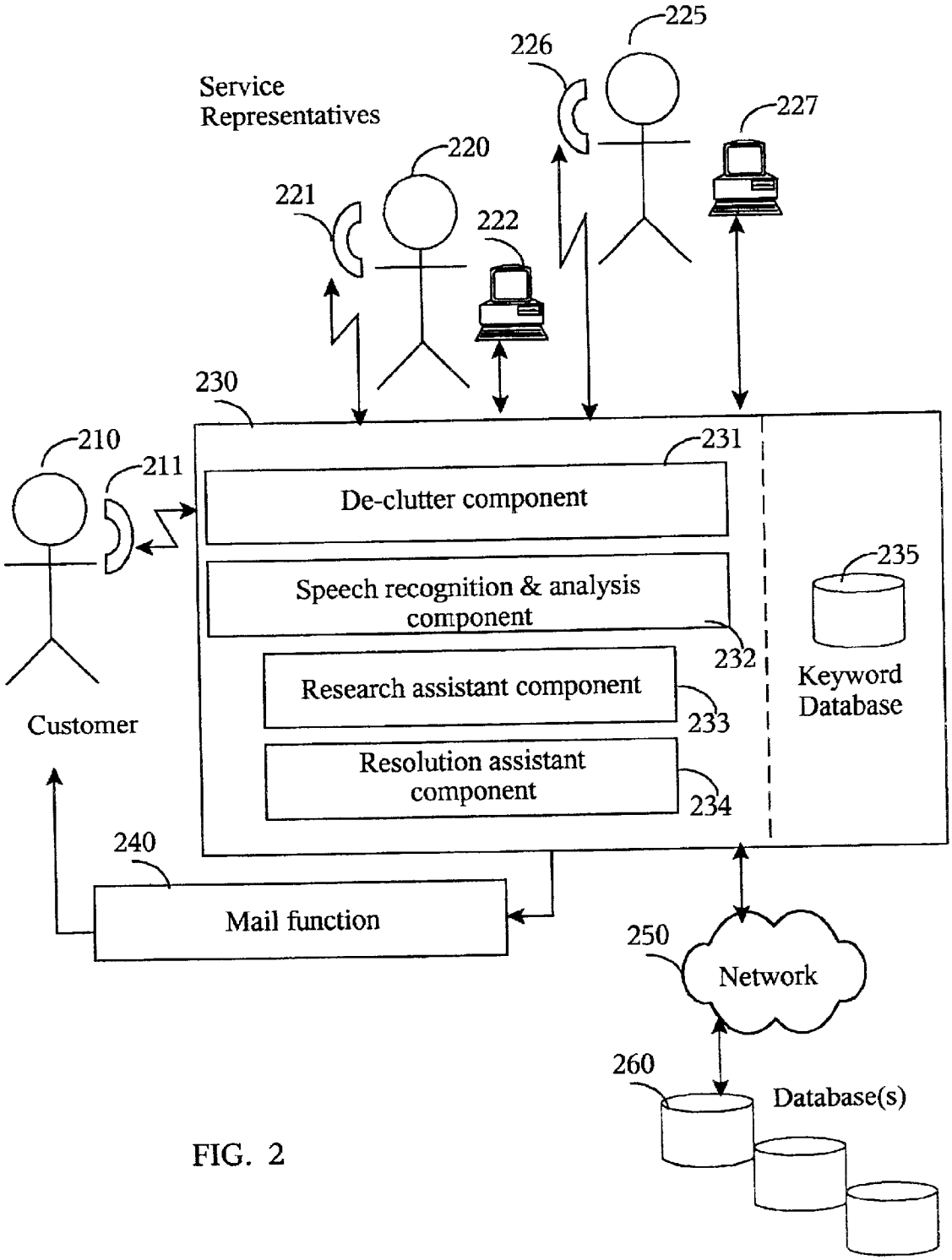
FIG. 2 is a high-level block diagram illustrating an example of a system employing computerized speech recognition and capturing customer speech, according to the teachings of the present invention.

FIG. 2 is a high-level block diagram illustrating an example of a system, 230, employing computerized speech recognition and capturing customer speech. System 230 is shown receiving speech input from two or more parties to a telephone conversation, including a first speaker (such as customer service representative 220 for example). System 230 blocks a portion of the speech input that originates from the first speaker (service representative 220) and performs speech recognition on the remaining portion of the speech input. The blocking and performing speech recognition are real-time processes, completed during a conversation. System 230 includes various components. De-clutter component 231 de-clutters the speech input from service representatives 220 and 225 and customer 210 for better automatic processing, by removing all but the pertinent words spoken by the customer. This will be explained in more detail below.

After capturing customer 210's speech, system 230 recognizes a key word in customer 210's speech. Based on said key word, system 230 searches a database 260, and retrieves information from database 260. System 230 includes a speech recognition and analysis component 232, that may be implemented with well-known speech recognition technologies.

System 230 includes a key word database or catalog 235 that comprises a list of searchable terms. An example is a list of terms in a software help index. As indicated by the dashed line, key word database 235 may be incorporated into system 230, or may be independent of, but accessible to, system 230. Key word database 235 may be implemented with database management software such as ORACLE, SYBASE, or IBM's DB2, for example. An organization may create key word database 235 by pulling information from existing databases containing customer data and product data, for example. A customer name is an example of a key word. A text extender function, such as that available with IBM's DB2, would allow a spoken name such as "Petersen" to be retrieved through searches of diverse spellings like "Peterson" or "Pedersen." Other technology similar to the above-mentioned examples also may be used.

System 230 may also include research assistant component 233, that would automate data-retrieval functions involved when service representatives 220 and 225 assist customer 210. Data may be retrieved from one or more databases 260, either directly or via network 250. Resolution assistant component 234 would automate actions to resolve problems for customer 210. Resolution assistant component 234 may employ mail function 240, representing an e-mail application, or conventional, physical mail or delivery services. Thus information, goods, or services could be supplied to customer 210.

In this example, service representatives 220 and 225 are shown interacting with customer 210 via telephone, represented by telephone hardware 211, 221, and 226. A similar system could be used for face-to-face interactions. Service representatives 220 and 225 are shown interacting with system 230 via computers 222 and 227. This represents a way to display information that is retrieved from database 260, to service representatives 220 and 225. Service representatives 220 and 225 may be located at the same place, or at different places.

Figure 3:
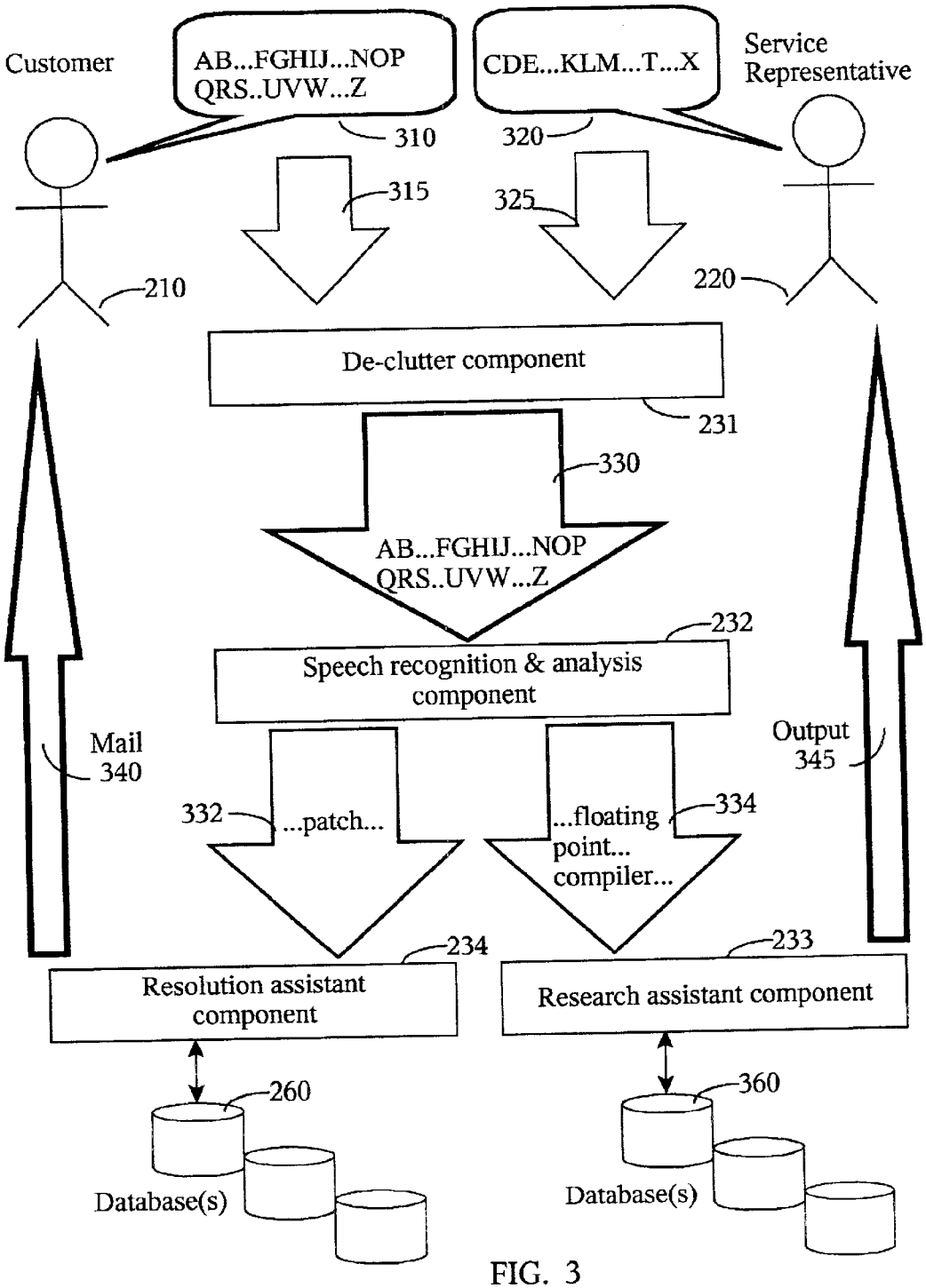
FIG. 3 illustrates selected operations of another exemplary system, employing computerized speech recognition and capturing customer speech.

FIG. 3 illustrates selected operations of another exemplary system, employing computerized speech recognition and capturing customer speech. Customer speech is symbolized by the letters in bubble 310. A service representative's speech is symbolized by the letters in bubble 320. De-clutter component 231 is shown receiving speech input (arrows 315 and 325) from two speakers, including a first speaker (service representative 220); blocking a portion of the speech input that originates from the first speaker (service representative 220); and processing the remaining portion of the speech input with a computer (speech recognition and analysis component 232). The blocking and processing are real-time processes, completed during a conversation. Speech recognition and analysis component 232 is shown receiving speech input (arrow 330) from a customer 210. Speech recognition and analysis component 232 performs speech recognition on the speech input to generate a text equivalent, and parses the text to identify key words (arrows 332 and 334).

The key words at arrows 332 and 334 ("patch," "floating point," and "compiler") are examples that may arise in the computer industry. Also consider an example from the financial services industry. A customer may ask for help regarding an Individual Retirement Account. A service representative may ask: "Did you say that you wanted help with a Roth IRA?" The customer may respond: "No, I need help with a standard rollover IRA." The present invention would block that portion of the speech input that originates from the service representative, and process the remaining portion of the speech input that contains "rollover" and "IRA" as examples of key words.

Research assistant component 233 is shown searching for an occurrence of key words 334 in a database 360, retrieving information from database 360, and providing retrieved information (arrow 345) to service representative 220. The retrieving is completed during a conversation involving customer 210 and service representative 220. Thus research assistant component 233 would automate data-retrieval functions involved when service representative 220 assists customer 210. Research assistant component 233 may be implemented with well-known search engine technologies. Databases shown at 360 may contain customer information, product information or problem management information, for example.

Resolution assistant component 234 is shown searching for an occurrence of a key word 332 in a database 260, retrieving information from database 260, and sending mail (arrow 340) to customer 210. Thus resolution assistant component 234 initiates action, based on a key word 332, to solve a problem affecting customer 210. Resolution assistant component 234 may initiate one or more tasks such as sending a message by e-mail, preparing an order form, preparing an address label, or routing a telephone call. Resolution assistant component 234 may be implemented with well-known search engine and e-mail technologies, for example. Databases shown at 260 may contain customer names and addresses, telephone call-routing information, problem management information, product update information, order forms, or advisory bulletins for example.

Figure 4:
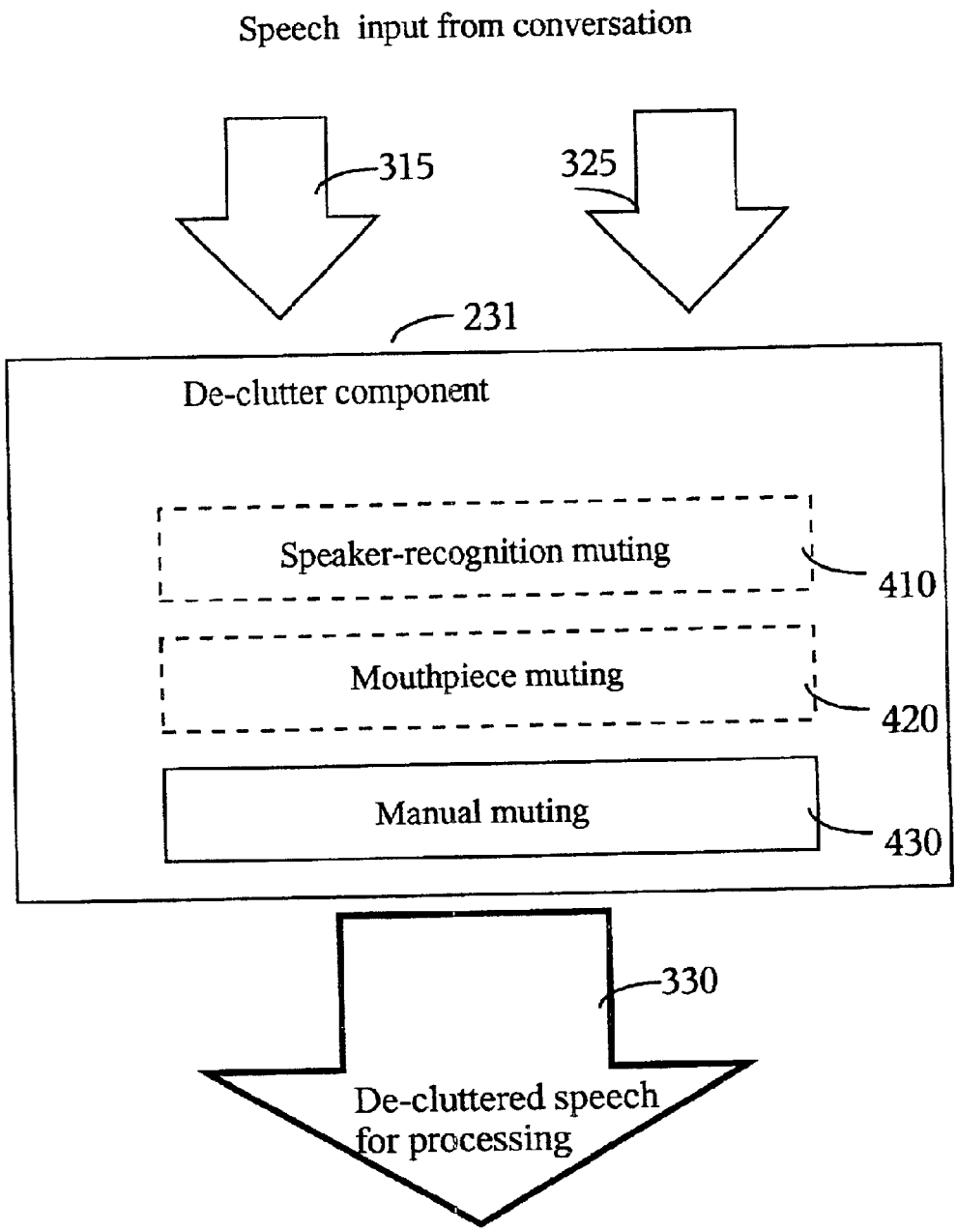
FIG. 4 is a block diagram illustrating selected operations and features of an exemplary system such as the ones in FIG. 2 or FIG. 3.

FIG. 4 is a block diagram illustrating selected operations and features of an exemplary system such as the ones in FIG. 2 or FIG. 3. De-clutter component 231 is shown receiving speech input (arrows 315 and 325) and providing de-cluttered speech (arrow 330) from a customer for processing. Blocks 410, 420, and 430 symbolize three functions that may be employed to de-clutter the speech input for better automatic processing, by removing all but the pertinent words spoken by the customer. As shown by the broken outline of blocks 410 and 420, speaker-recognition muting 410 and mouthpiece muting 420 would be two similar, optional functions; de-clutter component 231 typically would contain one of them but not both. Both speaker-recognition muting 410 and mouthpiece muting 420 would serve to block that portion of the speech input that originates from the service representative. As shown by the solid outline of block 430, manual muting would be a standard feature of de-clutter component 231. Manual muting 430 would serve to block all speech input temporarily. When a conversation would turn to small talk, for example, it might not contain useful information for customer service. Block 410, speaker-recognition muting, block 420, mouthpiece muting, and block 430, manual muting, are explained in more detail below.

Figure 5:
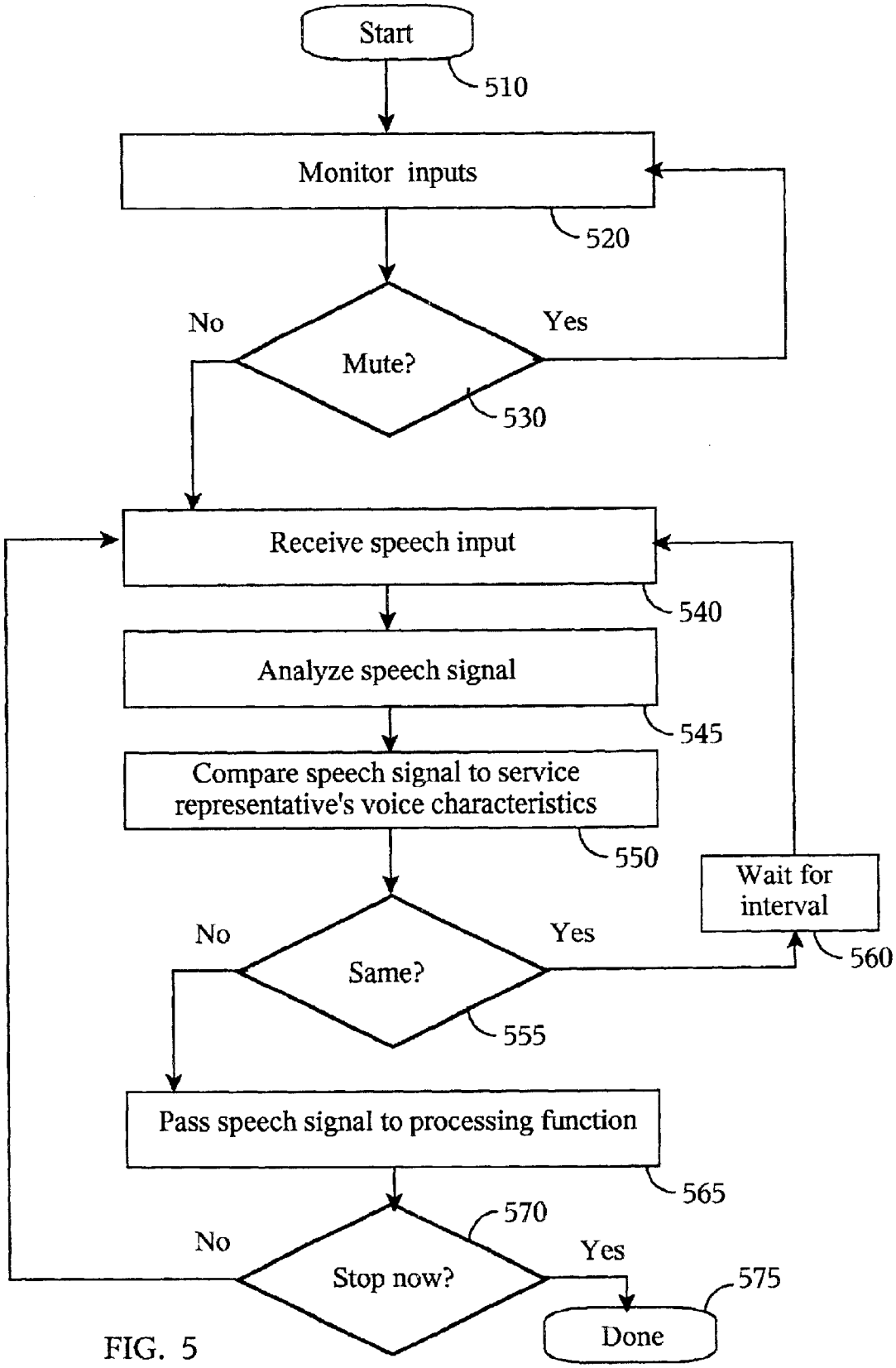
FIG. 5 is a flow chart illustrating an example of a process for manual muting and speaker-recognition muting, according to the teachings of the present invention.

FIG. 5 is a flow chart illustrating an example of a process for manual muting and speaker-recognition muting, according to the teachings of the present invention. Manual muting may be implemented in the form of well-known hardware receiving a command for muting from the customer service representative, and responsive to the command, interrupting speech input. Muting may be controlled by a touch pad or foot pedal that is provided for the customer service representative. On the other hand, manual muting may be implemented by software receiving a command for muting from the customer service representative, and responsive to the command, interrupting speech input. A service representative may send a command for muting, by clicking a mouse button, or touching a touch-sensitive screen with a stylus, or using a keyboard or some other input device.

Speaker-recognition muting would involve a pre-run-time step of storing voice characteristics of the customer service representative. Then at run time the process would involve performing speaker recognition (also known as voice recognition) on the speech input, and passing to a speech recognition function only that portion of the speech input that does not match the stored voice characteristics.

Speaker-recognition technology is well-known. Other names for it include "voice recognition," "voiceprint," "voice authentication" and "speaker verification." Speaker-recognition technology that may be suitable for implementing the present invention is used for security purposes, and is available from Nuance Communications, SpeechWorks International, and Keyware, for example.

The example of a process for manual muting and speaker-recognition muting in FIG. 5 starts at block 510. Block 520 and decision 530 represent manual muting. Inputs are monitored for commands at block 520. If the "Yes" branch is taken at decision 530, manual muting is active, and no speech is passed for processing; the inputs continue to be monitored at block 520.

If on the other hand the "No" branch is taken at decision 530, manual muting is not active. Next at block 540 the process receives speech input. At block 545 the process analyzes the speech signal, and at block 550 compares the speech signal to stored voice characteristics of the customer service representative. If the speaker recognition function determines that the voice currently in the speech signal matches the customer service representative's voice, the "Yes" branch is taken at decision 555. Next the process waits, 560, for a brief defined interval before it again receives speech input at block 540. If on the other hand the speech input does not match the stored voice characteristics, the "No" branch is taken at decision 555, and the speech signal is passed to a processing function at block 565. Decision 570 provides the option of stopping (e.g. at the end of a conversation). If the "Yes" branch is taken at decision 570, the process terminates at block 575.

Figure 6:
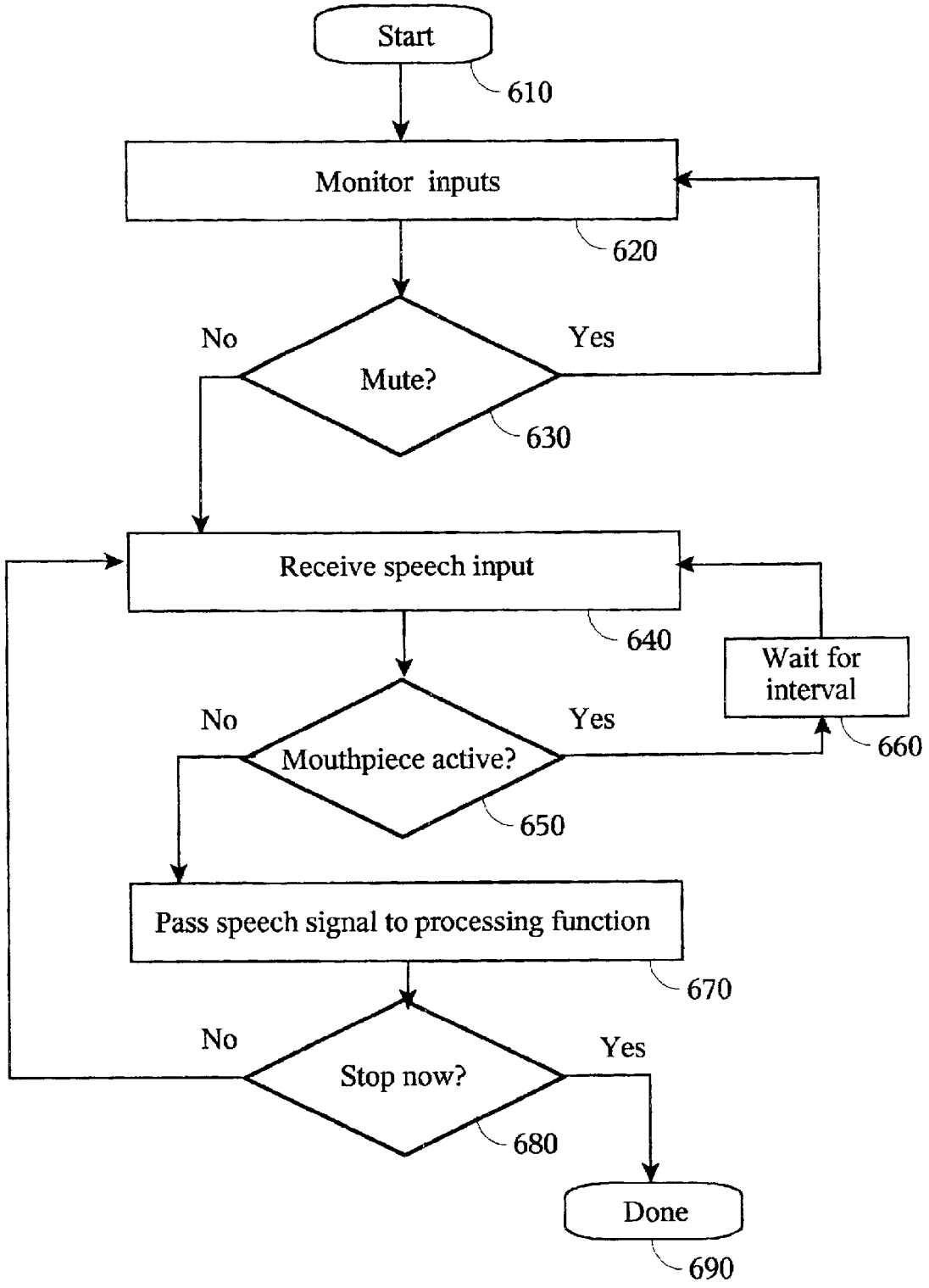
FIG. 6 is a flow chart illustrating an example of a process for manual muting and mouthpiece muting.

FIG. 6 is a flow chart illustrating an example of a process for manual muting and mouthpiece muting. Mouthpiece muting involves providing a speech-input device such as a mouthpiece or microphone for the customer service representative. The process starts at block 610. Block 620 and decision 630 represent manual muting. Inputs are monitored for commands at block 620. If the "Yes" branch is taken at decision 630, manual muting is active, and no speech is passed for processing; the inputs continue to be monitored at block 620.

If on the other hand the "No" branch is taken at decision 630, manual muting is not active. Next at block 640 the process receives speech input. At decision 650, the process determines whether a signal is being received from the customer service representative's speech-input device. If so, the "Yes" branch is taken at decision 650. Next the process waits, 660, for a brief defined interval before it again receives speech input at block 640. If the "No" branch is taken at decision 650, then at block 670 the process passes speech input to a processing function such as a speech recognition function (only when no signal is being received from the service representative's speech-input device). Note that this would have the de-cluttering effect of blocking speech input when both customer and service representative speak at the same time. Decision 680 provides the option of stopping (e.g. at the end of a conversation). If the "Yes" branch is taken at decision 680, the process terminates at block 690.

Those skilled in the art will recognize that blocks in the above-mentioned flow charts could be arranged in a somewhat different order, but still describe the invention. Blocks could be added to the above-mentioned flow charts to describe window-managing details, or optional features; some blocks could be subtracted to show a simplified example.

In conclusion, examples have been shown of methods and systems employing computerized speech recognition and capturing customer speech to improve customer service.

One of the preferred implementations of the invention is an application, namely a set of instructions (program code) in a code module which may, for example, be resident in the random access memory of a computer. Until required by the computer, the set of instructions may be stored in another computer memory, for example, in a hard disk drive, or in a removable memory such as an optical disk (for eventual use in a CD ROM) or floppy disk (for eventual use in a floppy disk drive), or downloaded via the Internet or other computer network. Thus, the present invention may be implemented as a computer-usable medium having computer-executable instructions for use in a computer. In addition, although the various methods described are conveniently implemented in a general-purpose computer selectively activated or reconfigured by software, one of ordinary skill in the art would also recognize that such methods may be carried out in hardware, in firmware, or in more specialized apparatus constructed to perform the required method steps.

While the invention has been shown and described with reference to particular embodiments thereof, it will be understood by those skilled in the art that the foregoing and other changes in form and detail may be made therein without departing from the spirit and scope of the invention. The appended claims are to encompass within their scope all such changes and modifications as are within the true spirit and scope of this invention. Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the appended claims may contain the introductory phrases "at least one" or "one or more" to introduce claim elements. However, the use of such phrases should not be construed to imply that the introduction of a claim element by indefinite articles such as "a" or "an" limits any particular claim containing such introduced claim element to inventions containing only one such element, even when the same claim includes the introductory phrases "at least one" or "one or more" and indefinite articles such as "a" or "an;" the same holds true for the use in the claims of definite articles.

We claim:

1. A method for handling information communicated by voice, said method comprising:

receiving speech input from a plurality of speakers, including a first speaker;

blocking a portion of said speech input that originates from said first speaker; and processing the remaining portion of said speech input with a computer, wherein said blocking and said processing are completed during a conversation involving said plurality of speakers.

2. The method of claim 1, wherein said blocking further comprises:

storing voice characteristics of said first speaker;

performing speaker recognition on said speech input;

passing to a processing function only that portion of said speech input that does not match said stored voice characteristics.

3. The method of claim 1, wherein said blocking further comprises:

providing a first speech-input device for said first speaker;

determining whether a signal is being received from said first speech-input device;

passing said speech input to a processing function only when no signal is being received from said first speech-input device.

4. The method of claim 1, further comprising:

receiving a command for muting from said first speaker; and responsive to said command, interrupting said speech input.

5. A method for handling information communicated by voice, said method comprising:

receiving speech input from a plurality of parties to a telephone conversation, including a first speaker;

blocking a portion of said speech input that originates from said first speaker; and performing speech recognition on the remaining portion of said speech input, wherein said blocking, and said performing speech recognition, are completed during said telephone conversation.

6. The method of claim 5, further comprising identifying key words in said remaining portion.

7. The method of claim 5, wherein said blocking further comprises:

storing voice characteristics of said first speaker;

performing speaker recognition on said speech input;

passing to a speech recognition function only that portion of said speech input that does not match said stored voice characteristics.

8. The method of claim 5, wherein said blocking further comprises:

providing a first speech-input device for said first speaker;

determining whether a signal is being received from said first speech-input device;

passing said speech input to a speech recognition function only when no signal is being received from said first speech-input device.

9. The method of claim 5, further comprising:

receiving a command for muting from said first speaker; and responsive to said command, interrupting said speech input.

10. A system for handling information communicated by voice, said system comprising:

means for receiving speech input from a plurality of parties to a telephone conversation, including a first speaker;

means for blocking a portion of said speech input that originates from said first speaker; and means for performing speech recognition on the remaining portion of said speech input, wherein said means for blocking, and said means for performing speech recognition, complete their operations during said telephone conversation.

11. The system of claim 10, further comprising means for identifying key words in said remaining portion.

12. The system of claim 10, wherein said means for blocking further comprises:

means for storing voice characteristics of said first speaker;

means for performing speaker recognition on said speech input;

means for passing to a speech recognition function only that portion of said speech input that does not match said stored voice characteristics.

13. The system of claim 10, wherein said means for blocking further comprises:

a first speech-input device for said first speaker;

means for determining whether a signal is being received from said first speech-input device;

means for passing said speech input to a speech recognition function only when no signal is being received from said first speech-input device.

14. The system of claim 10, further comprising:

means for receiving a command for muting from said first speaker; and means responsive to said command, for interrupting said speech input.

15. A computer-usable medium having computer-executable instructions for handling information communicated by voice, said computer-executable instructions comprising:

means for receiving speech input from a plurality of parties to a telephone conversation, including a first speaker;

means for blocking a portion of said speech input that originates from said first speaker; and means for performing speech recognition on the remaining portion of said speech input, wherein said means for blocking, and said means for performing speech recognition, complete their operations during said telephone conversation.

16. The computer-usable medium of claim 15, further comprising means for identifying key words in said remaining portion.

17. The computer-usable medium of claim 15, wherein said means for blocking further comprises:

means for storing voice characteristics of said first speaker;

means for performing speaker recognition on said speech input;

means for passing to a speech recognition function only that portion of said speech input that does not match said stored voice characteristics.

18. The computer-usable medium of claim 15, wherein said means for blocking further comprises:

means for determining whether a signal is being received from a first speech-input device for said first speaker;

means for passing said speech input to a speech recognition function only when no signal is being received from said first speech-input device.

19. The computer-usable medium of claim 15, further comprising:

means for receiving a command for muting from said first speaker; and means responsive to said command, for interrupting said speech input.

* * * * *